US010553372B2

(12) United States Patent
Gentsch

(10) Patent No.: US 10,553,372 B2
(45) Date of Patent: Feb. 4, 2020

(54) VACUUM INTERRUPTER WITH ONE MOVABLE CONTACT

(71) Applicant: ABB Schweiz AG, Baden (CH)

(72) Inventor: Dietmar Gentsch, Ratingen (DE)

(73) Assignee: ABB SCHWEIZ AG, Baden (CH)

( * ) Notice: Subject to any disclaimer, the term of this patent is extended or adjusted under 35 U.S.C. 154(b) by 0 days.

(21) Appl. No.: 15/960,578

(22) Filed: Apr. 24, 2018

(65) Prior Publication Data

US 2018/0240615 A1 Aug. 23, 2018

Related U.S. Application Data

(63) Continuation of application No. PCT/EP2016/075690, filed on Oct. 25, 2016.

(30) Foreign Application Priority Data

Oct. 26, 2015 (EP) ..... 15191532

(51) Int. Cl.
*H01H 3/32* (2006.01)
*H01H 9/04* (2006.01)
*H01H 11/00* (2006.01)

(52) U.S. Cl.
CPC ..... *H01H 9/041* (2013.01); *H01H 3/32* (2013.01); *H01H 11/00* (2013.01); *H01H 2205/002* (2013.01); *H01H 2223/002* (2013.01)

(58) Field of Classification Search
CPC ..... H01H 9/041; H01H 3/32; H01H 33/662; H01H 33/66238; H01H 33/66207; H01H 2033/66253; H01H 2033/66215
(Continued)

(56) References Cited

U.S. PATENT DOCUMENTS 3,185,800 A * 5/1965 Titus ..... H01H 33/66261 218/136
4,557,529 A 12/1985 Cherry et al.
(Continued)

FOREIGN PATENT DOCUMENTS

DE 102008018531 B3 9/2009
EP 660354 A2 6/1995
(Continued)

OTHER PUBLICATIONS

Translation of JP2013048034 (Year: 2013).*
(Continued)

*Primary Examiner* — Edwin A. Leon
*Assistant Examiner* — William A Bolton
(74) *Attorney, Agent, or Firm* — Leydig, Voit & Mayer, Ltd.

(57) ABSTRACT

A vacuum interrupter includes: one movable contact fixed on a movable contact stem; and one fixed contact with a fixed contact stem. The fixed contact and the movable contact are located in a electrically insulating tube, which is vacuumtightly closed by metal lids at boths sides. The fixed contact stem is placed vacuumtightly on one of the metal lids, and the movable contact stem is guided trough an opening of the opposite metal lid via an axially extendable vacuumtight bellow. In order to create a twist protection of the movable contact stem, a ring disc shaped plastic part with a central opening, through which the movable contact stem is guided, is connected externally to the vacuum interrupter such that inner spanner flats inside the opening complementarily fit closely to external spanner flats of the movable contact stem.

10 Claims, 2 Drawing Sheets

(58) Field of Classification Search
USPC ..... 218/158, 118, 123, 134, 135
See application file for complete search history.

(56) References Cited

U.S. PATENT DOCUMENTS

| | | | | |
|---|---|---|---|---|
| 5,510,592 | A | 4/1996 | Gentsch et al. | |
| 5,543,598 | A * | 8/1996 | Duffour | H01H 33/66238 218/134 |
| 2007/0007250 | A1* | 1/2007 | Li | H01H 33/66207 218/134 |
| 2012/0276755 | A1* | 11/2012 | Sato | C10M 169/02 439/3 |
| 2014/0291293 | A1* | 10/2014 | Gentsch | H01H 33/66207 218/139 |

FOREIGN PATENT DOCUMENTS

| | | | |
|---|---|---|---|
| JP | S 51151961 | U | 12/1976 |
| JP | S 5828119 | A | 2/1983 |
| JP | 2013048034 | A | 3/2013 |
| RU | 2230383 | C2 | 6/2004 |

OTHER PUBLICATIONS

Database WPI, Week 198313, Thomson Scientific, London, GB; AN 1983-30816K, XP002753375, Mar. 1983, p. 1.
Database WPI, Week 201319, Thomson Scientific, London, GB; AN 2013-D28286, XP002753376, May 2013, p. 1.

* cited by examiner

VACUUM INTERRUPTER WITH ONE MOVABLE CONTACT

CROSS-REFERENCE TO PRIOR APPLICATION

This application is a continuation of International Patent Application No. PCT/EP2016/075690, filed on Oct. 25, 2016, which claims priority to European Patent Application No. EP 15191532.9, filed on Oct. 26, 2015. The entire disclosure of both applications is hereby incorporated by reference herein.

FIELD

The invention relates to a vacuum interrupter with one movable contact fixed on a movable contact stem, and at least one fixed contact with a fixed contact stem, wherein fixed and movable contact or contacts are located in a electrically insulating tube, which is vacuumtightly closed by metal lids at boths sides of the insulating tube, wherein the fixed contact stem is placed vacuumtightly on one of the metal lids, and the movable contact stem is guided trough an opening of the opposite metal lid via an axially extendable vacuumtight bellow.

BACKGROUND

The actual solution of the vacuum interrupter which are used for contactor and load break switch application are assembled and brazed with different and deep drawn parts on the movable and the fixed contact side. To realize the torque protection a spanner flat can be provided at the movable stem and surface protection by hardening, and a spanner inside the central opening at the counterpart.

After the brazing process grease has to be applied, to get the needed guidance and less friction due to the application of grease.

SUMMARY

In an embodiment, the present invention provides a vacuum interrupter, comprising: one movable contact fixed on a movable contact stem; and one fixed contact with a fixed contact stem, wherein the fixed contact and the movable contact are located in a electrically insulating tube, which is vacuumtightly closed by metal lids at boths sides, wherein the fixed contact stem is placed vacuumtightly on one of the metal lids, and the movable contact stem is guided trough an opening of the opposite metal lid via an axially extendable vacuumtight bellow, wherein, in order to create a twist protection of the movable contact stem, a ring disc shaped plastic part with a central opening, through which the movable contact stem is guided, is connected externally to the vacuum interrupter such that inner spanner flats inside the opening complementarily fit closely to external spanner flats of the movable contact stem.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
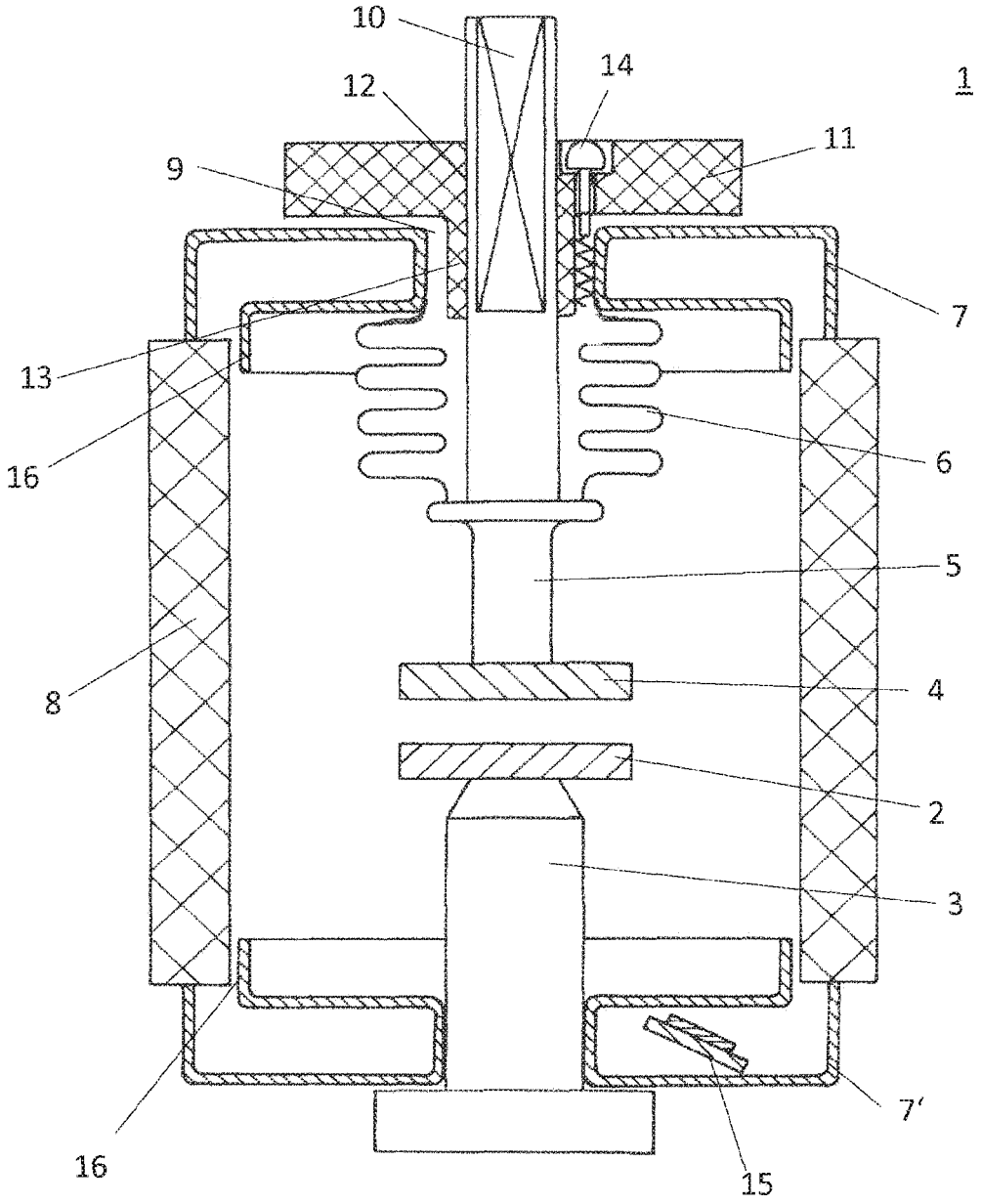
FIG. 1 longitudinal cut trough a vacuum interrupter with hollow lids

So the invention in detail is, that in order to create a twist protection of the movable contact stem a ring disc shaped plastic part with a central opening, through which the movable contact stem is guided, is fixed externally to the vacuum interrupter in such, that inner spanner flats inside the central opening of the plastic part complementarily fits closely to external spanner flats of the movable contact stem. By that a constructural easy part is used for twist protection of the movable contact stem.

In order to guarantee the twist protection, the aforesaid plastic part is fixed to the concerning metal lid, trough which is vacuumtightly guided the aforesaid movable contact stem via the bellow.

In an advantageous embodiment, the aforesaid plastic part is simply fixed in its angular position to the aforesaid metal lid by a self tapping screw.

In order to realize an affective positioning of the twist protection, the inner diameter of the opening of the metal lid at the movable contact stem side and the outer diameter of movable contact stem are dimensioned as such, that a circular ring slot occurs, and that the twist protecting plastic part is provided with a tube like section which fits into the aforesaid circular ring slot.

This ensures a solid fixation of the twist protection.

This fixation is further enhanced in an advantageous embodiment by that the aforesaid self tapping screw is screwed into the circular slot at an arbitrary angularity.

So the inner spanner flats of the opening in the plastic part complementarily fits with the outer spanner flats of the movable contact stem, and additionally the tube like section of the plastic part is introduced into the ring slot of the opening of the metal lid. Finally the self tapping screw, screwed into this ring slot section between the movable contact stem and the metal lid can be screwed in at arbitrary angularity, that means in a arbitrary angular position.

The combination of all these aforesaid features are a best mode embodiment of the invention.

Furthermore the insulating tube of the vacuum interrupter is made of ceramic.

In a further advantageous embodiment, the metal lids are brazed vacuumtightly and circumferentially to the end faces of the insulating tube.

In a further advantageous embodiment, the metal lids are made of deep drawn sheet metal parts, and that at that side of the lids, which are oriented to the inner volume of the vacuum interrupter, an annular entry pilot is formed integrally at that side of the metal lids, for self centering of the the metal lid, when it is positioned at the ceramic tube, before brazing.

Further advantageous is, that the touching spanner flats of the movable stem and/or the spanner flats of the plastic part are covered with grease.

In a further advantageous embodiment, at least one of the metal lids is made of a deep drawn part, with an inner circumferential tubelike, that means as an annular entry pilot formed integrally at that side of the metal lids section in order of centering the metal lid, and an outer circumferential sealing edge, brazed vacuumtightly at one of the end faces of the insulating ceramic tube.

In a further advantageous embodiment, at least one of the metal lids is made of a solid round turned metal body, with an inner circumferential tubelike section as an annular entry pilot is formed integrally at that side of the metal lids in order of centering the metal lid, and an outer circumferential sealing edge, brazed vacuumtightly at one of the end faces of the insulating ceramic tube.

According to that several alternatives result out of that.

At least one of the metal lids can be carried out as deep drawn metal sheet part, or both of them, which already results in two alternatives.

Or at least one of the metal lids can be carried out as turned solid metal parts, or both.

As a result of these alternative enumerations, it is possible, that one of the metal lids can be carried out as deep drawn part, and the other as turned solid metal part.

In the case of the use of a deep drawn metal sheet part, the metal lid encloses an inner volume, not fully sealed against the inner vacuum volume. Therefore it is advantageous, that in a final embodiment, inside the inner volume of the hollow metal lid, is arranged at least one getter element, in order to be able, to hold a constant vacuum.

In sum, the resulted advantages are as follows.

The choice of a plastic part for twist and/or torque protection is intended in order to get better performance of the contactor and the load break switch from the "friction" point of view. The plastic part can be assembled after the brazing process of the vacuum interrupter without any needed tooling/jig to get positioning between the movable stem and the metal lid.

The new Idea is, to use the plastic part with spanner flat inside the central opening and the spanner flat at the movable contact stem. After positioning of both parts the plastic torque protection will be fixed mainly by the application of a self-tapping screw between the plastic part opening and the lid inner side of the central opening. Here the connection takes place because the screw will get the thread inside the lid during turning of the screw, using the self-tapping effect.

A glue can be used in addition but for long term application, but the screw is placed to hold the torque protection part in position.

In consequence of the alternative construction of the lids as deep drawn hollow parts or as turned solid parts, several constructural details follows out of that.

If the lids on the movable- and the fixed contact stem side are designed as same parts and can be used to braze at the fixed contact side, the stem inside the lid and on the movable side the bellows inside the lid and the plastic part is placed on top of the lid side and under the application mainly due to the self-tapping screw the part will be fixed at the place. Here a glue can be used in addition.

In case of hollow lids manufactured by a deep drawn sheet metal part will be used, a getter in form of a strip or a disc can be introduced inside the hollow area of the lid before the assembly of the part at the ceramic and before brazing. After brazing the gap between the lid and the ceramic is so less or tight that the getter strip or the disc can't release the part inside the vacuum interrupter contact area, self-closing area and reduced assembly effort needed.

In case of solid lids, the part can be produced from a tube as a turned part as well. Here the getter material has to be placed at a different location.

One final but basically important for the invention, is the embodiment, that both lids are basically identical, concerning there dimensions and their central opening. So the lid for the upper part, at the moving contact side, and the lid of the lower part, at the fixed contact side are identical, in order optimize the manufacture of the vacuum interrupter.

At the fixed contact side, the stem is vacuum tight fixed in the aforesaid central opening of that lid.

At the movable contact side, the bellow is vacuum tight fixed at that lid.

In both cases, the opening dimensions and their positions are equal.

FIG. 1 shows in a longitudinal cut through the vacuum interrupter 1. The fixed contact 2 is fixed to a fixed contact stem 3. The movable contact 4 is fixed to movable contact stem 5. The movable contact stem 5 allows the axial movement by the use of the bellow 6, which is vacuum-tightly fixed to the movable contact stem 5 at one side, and at the concerning lid 7 at the other side. The contact arrangement is arranged in a tube 8, made of insulating material, preferably vacuumtight ceramic material. The lids 7, 7' on both sides of the vacuum interrupter are brazed along a circumferential closed line on the face sides of the ceramic tube 8 on both sides. The lid 7' at the fixed contact side is brazed vacuumtightly to the fixed contact stem 3.

The movable contact stem 5 at the opposite side of the vacuum interrupter is guided through the bellow 6, vacuum tightly through the concerning lid 7 at that side, and will be mechanically linked to an external drive.

Between the movable contact stem and the opening in the concerning lid, a circular slot occurs.

In order to realize a twist and/or torque protection of the movable contact stem, the movable contact stem is provided with spanner flats 10 on its outer surface.

At that position, a disc shaped plastic part 11 is arranged. The plastic part 11 is provided with complementary inner spanner flats 12 at the inner surface of the opening in the plastic part, which corresponds with the spanner flats at the movable contact stem.

Additionally the plastic part is provided with a tubelike section 13, by which the plastic part 11 can be introduced into the aforesaid circular slot between the movable contact stem and the opening in the concerning lid.

Furthermore the plastic part as twist and/or torque protection can be fixed by a self tapping screw 14, screwed into the plastic part near the aforesaid circular slot.

Furthermore, FIG. 1 shows the use of lids, made of deep drawn metal sheets material, so that they are carried out as being hollow.

In case of hollow lids 7', inside the hollow volume, getter material strips 15 or elements are placed.

The lids 7, 7' are structured furthermore in such, that an outer circular edge will be brazed vacuumtightly to the face sides of the insulating ceramic tube of the vacuum interrupter.

An inner circular kind of collar 16 of the lid is used as an entry pilot, in order to result in a self centering, when the lid is positioned to the insulating ceramic tube, before brazing. The lid martial is preferably metal.

Figure 2:
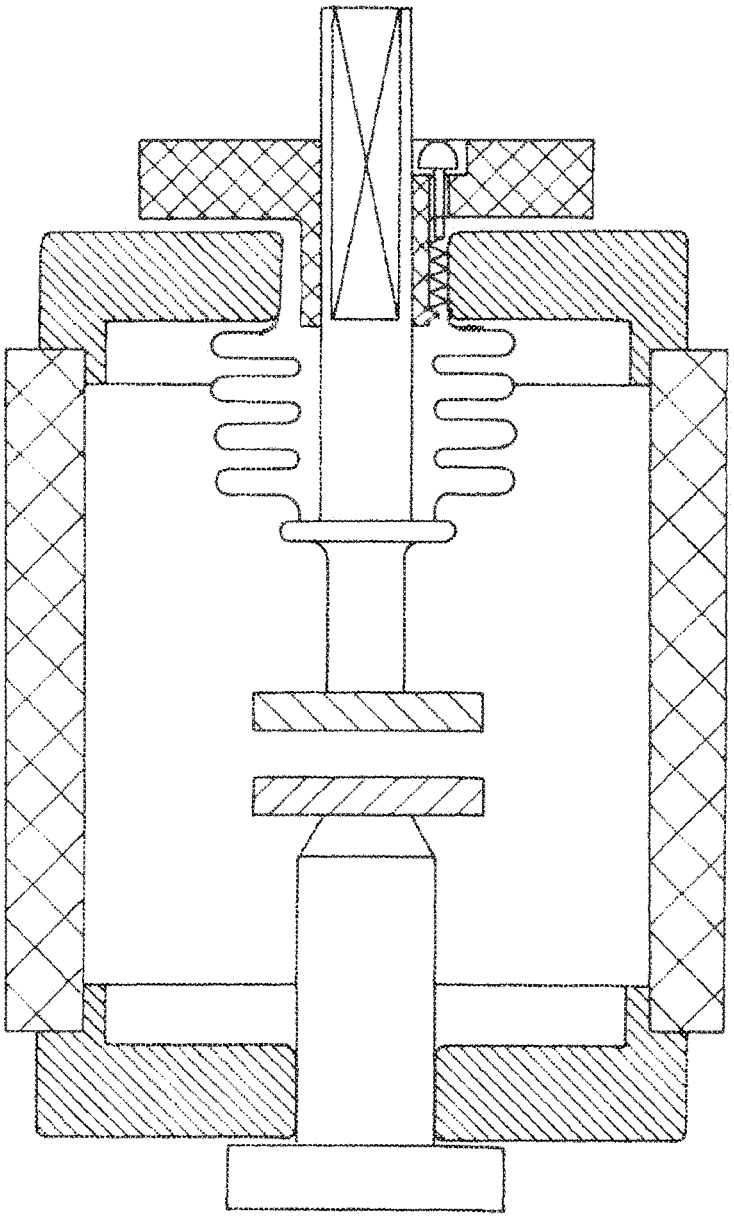
FIG. 2 longitudinal cut trough a vacuum interrupter with solid turned lids

The embodiment in FIG. 2 has the same features as the embodiment in FIG. 1, except of the fact, that the lids are made of solid turned material, but with the same detailed features, that means with an outer circular edge, to be brazed on the end faces of the insulating ceramic tube.

Also the inner circular entry pilot is made by turning this structure to a solid material, preferably metal.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

NUMBERING

1 vacuum interrupter
2 fixed contact
3 contact stem
4 movable contact
5 movable contact stem
6 bellow
7 lid
7' lid
8 tube
9 slot, circumferential
10 spanner flats
11 plastic part
12 inner spanner flats
13 tubelike section
14 self tapping screw
15 getter material strips
16 collar

What is claimed is:

1. A vacuum interrupter, comprising:

one movable contact fixed on a movable contact stem, the movable contact stem having external spanner flats; and one fixed contact with a fixed contact stem, wherein the fixed contact and the movable contact are located in an electrically insulating tube, which is vacuumtightly closed by metal lids at both sides, wherein the fixed contact stem is placed vacuumtightly on a first of the metal lids, and the movable contact stem is guided through an opening of a second of the metal lids via an axially extendable vacuumtight bellows, wherein, in order to create a twist protection of the movable contact stem, a ring disc shaped plastic part with a central opening, through which the movable contact stem is guided, and inner spanner flats inside the central opening, is connected externally to the vacuum interrupter such that the inner spanner flats complementarily fit closely to the external spanner flats of the movable contact stem, wherein the plastic part is fixed to the second metal lid, wherein the plastic part is fixed in an angular position to the second metal lid by a self tapping screw, wherein an inner diameter of the opening of the second metal lid and an outer diameter of the movable contact stem are dimensioned so as to form a circular ring slot, and wherein the self tapping screw is screwed into the circular ring slot at an arbitrary angularity.

2. The vacuum interrupter according to claim 1, wherein the twist protecting plastic part is provided with a tube section which fits into the circular ring slot.

3. The vacuum interrupter according to claim 1, wherein the insulating tube of the vacuum interrupter is comprised of ceramic.

4. The vacuum interrupter according to claim 1, wherein the metal lids are brazed vacuumtightly and circumferentially to end faces of the insulating tube.

5. The vacuum interrupter according to claim 1, wherein the metal lids are comprised of deep drawn sheet metal parts, wherein the metal lids are oriented to an inner volume of the vacuum interrupter, and wherein an annular entry pilot comprising a collar is integrally formed at a side of each of the metal lids so as to self center each metal lid when the metal lid is positioned at the ceramic tube before brazing.

6. The vacuum interrupter according to claim 1, wherein the spanner flats of the movable stem and/or the spanner flats of the plastic part are covered with grease.

7. The vacuum interrupter according to claim 1, wherein at least one of the metal lids is comprised of a deep drawn part which encloses partly an inner volume, with an inner circumferential tube section in order to center the metal lid, and an outer circumferential sealing edge, brazed vacuumtightly at one end face of the insulating ceramic tube.

8. The vacuum interrupter according to claim 7, wherein at least one getter element is arranged inside the inner volume of the first metal lid.

9. The vacuum interrupter according to claim 1, wherein at least one of the metal lids is comprised of a solid round turned metal body, with an inner circumferential tube section in order to center the metal lid, and an outer circumferential sealing edge, brazed vacuumtightly at one end face of the insulating ceramic tube.

10. The vacuum interrupter according to claim 1, wherein both lids are identical with respect to their dimensions and central opening.

* * * * *